US006748722B2

(12) United States Patent
Correll

(10) Patent No.: US 6,748,722 B2
(45) Date of Patent: Jun. 15, 2004

(54) METHOD FOR REDUCING HEAT LOSS OF HOT PIZZERIA PIZZA SHIPPED IN CORRUGATED BOX PACKAGING

(76) Inventor: John D. Correll, 8459 Holly Dr., Canton, MI (US) 48187-4237

( * ) Notice: Subject to any disclaimer, the term of this patent is extended or adjusted under 35 U.S.C. 154(b) by 0 days.

(21) Appl. No.: 10/319,968

(22) Filed: Dec. 16, 2002

(65) Prior Publication Data

US 2003/0079445 A1 May 1, 2003

Related U.S. Application Data

(63) Continuation-in-part of application No. 09/730,294, filed on Dec. 5, 2000, which is a continuation-in-part of application No. 09/551,245, filed on Apr. 17, 2000, now Pat. No. 6,290,122, and a continuation-in-part of application No. 09/394,784, filed on Sep. 13, 1999, now Pat. No. 6,206,277, which is a continuation-in-part of application No. 09/061,302, filed on Apr. 16, 1998, now Pat. No. 5,961,035, which is a continuation-in-part of application No. 08/731,586, filed on Oct. 16, 1996, now Pat. No. 5,833,130.

(51) Int. Cl.[7] ..... B65B 5/04

(52) U.S. Cl. ..... 53/467; 229/104; 229/906

(58) Field of Search ..... 229/101, 104, 229/161, 406, 906, 112; 53/467

(56) References Cited

U.S. PATENT DOCUMENTS

| | | | | | |
|---|---|---|---|---|---|
| 4,096,948 | A | | 6/1978 | Kuchenbecker | 206/622 |
| 4,260,060 | A | | 4/1981 | Faller | 206/622 |
| 4,717,069 | A | * | 1/1988 | Pizzolato | 229/104 |
| 5,077,455 | A | | 12/1991 | Peleg et al. | 219/10.55 E |
| 5,209,392 | A | * | 5/1993 | Anatro | 229/117.01 |
| 5,253,800 | A | * | 10/1993 | France | 229/109 |
| 5,402,930 | A | * | 4/1995 | Storms et al. | 229/125.28 |
| 5,423,477 | A | * | 6/1995 | Valdman et al. | 229/104 |
| 5,535,940 | A | * | 7/1996 | Olds | 229/110 |
| 5,549,241 | A | | 8/1996 | Correll | 229/120.01 |
| 5,704,483 | A | * | 1/1998 | Groh | 206/511 |
| 5,799,864 | A | * | 9/1998 | Mertz | 229/196 |

* cited by examiner

*Primary Examiner*—Stephen F. Gerrity
*Assistant Examiner*—Thanh Truong

(57) ABSTRACT

A method for reducing heat loss of hot pizzeria pizza shipped in corrugated box packaging. The method involves placing a recently-cooked pizzeria pizza into a corrugated box having at least one tab-like structure projecting downward from a wall structure of the box and extending beyond a bottom edge of a wall panel by a distance of at least nine millimeters when the box is in a fully-erected format, whereby the method solves the problem of a downward-warping bottom panel of a loaded corrugated pizza box coming into contact with a cool support surface underneath the box.

25 Claims, 5 Drawing Sheets

METHOD FOR REDUCING HEAT LOSS OF HOT PIZZERIA PIZZA SHIPPED IN CORRUGATED BOX PACKAGING

CROSS-REFERENCES TO RELATED APPLICATIONS

This is a continuation-in-part application of my application Ser. No. 09/730,294, entitled "Heat-retaining Boxing and Holding Method for Pizza," filed Dec. 5, 2000, which is a continuation-in-part of application Ser. No. 09/551,245, entitled "Versatile Pizza Carton," filed Apr. 17, 2000, now U.S. Pat. No. 6,290,122, and of application Ser. No. 09/394,784, entitled "Quality-enhancing Pizza Carton," filed Sep. 13, 1999, now U.S. Pat. No. 6,206,277, which is a continuation-in-part of application Ser. No. 09/061,302, entitled "Designer Pizza Box with Enhancements," filed Apr. 16, 1998, now U.S. Pat. No. 5,961,035, which is a continuation-in-part of application Ser. No. 08/731,586, entitled "Multi-function Pizza Carton, filed Oct. 16, 1996, now U.S. Pat. No. 5,833,130.

FIELD OF THE INVENTION

This invention relates to packaging methods in general and, in particular, to methods for reducing heat loss of hot pizzeria pizza shipped in corrugated box packaging.

DESCRIPTION OF THE PRIOR ART

Each year the pizzeria industry sells millions of hot pizzas in corrugated boxes for delivery and carry-out. The eating enjoyment of these pizzas is, in large part, determined by the temperature of the product at the time the pizza-eater consumes it. So providing for a hotter boxed pizza is a priority of many pizza companies.

Most delivery/carry-out pizza companies use a particular shipping method, which we call the "conventional shipping method," involving a conventional corrugated pizza box similar in structure to the box shown in Anatro U.S. Pat. No. 5,209,392 (Recyclable Pizza Box) granted May 11, 1993. Referencing the component numerals shown in FIGS. 2, 3, and 6 of Anatro, the conventional corrugated pizza box has a double-panel front wall structure comprising an outer panel (48) and an inner panel (50). Along the bottom edge of the outer panel are two tabs (60, 62). The purpose of these tabs is to provide slots in the bottom side of the box when the blank is erected into the box.

The conventional shipping method involves the steps of (a) placing a recently-cooked (i.e., hot) pizza into the conventional corrugated pizza box, (b) transporting the conventional corrugated pizza box loaded with hot pizza to an outlying place of consumption, such as a pizza-eater's residence, and, once there, (c) setting the pizza-loaded box onto a cool support surface, such as a table or counter. While sitting on the table the bottom panel of the box contacts the tabletop. This contact results in conduction of heat from the pizza through the box's bottom panel and into the table. That, in turn, contributes to rapid cooling of the pizza. Therefore, it would be desirable to eliminate contact of the bottom panel of corrugated pizza box packaging with the tabletop in pizza consumers' residences and, thereby, slow down the rate of cooling of the pizza shipped in corrugated box packaging.

In viewing the conventional corrugated pizza box (i.e., FIGS. 2 and 3 of Anatro), it might be concluded that, due to the front wall tabs (60, 62), the bottom panel (14) of this box would be held above a support surface that the box would happen to be sitting upon. However, this conclusion is incorrect. When this box is loaded with hot pizza, the bottom panel warps downward due to the heat and moisture of the hot pizza. This warping effect results in the bottom panel coming into contact with any support surface the box might be sitting upon. Hence, in the loaded conventional corrugated pizza box the tabs (60, 62) are ineffective in keeping a downward-warping bottom panel of the box free of contact with a cool support surface below.

The most common support surface is a tabletop, or countertop. However, other cool surfaces which the pizza-loaded corrugated box might contact include (a) the floor of an automotive vehicle, (b) the cover of another pizza-loaded box, and (c) the inside surface or support platform of a delivery pizza holding device, such as a delivery bag or rigid foam box. It would be desirable to eliminate contact of the bottom panel of the pizza-loaded corrugated box with these surfaces, as well.

Since some pizza orders involve two pizzas, the conventional shipping method also might involve stacking one pizza-loaded corrugated box on top of another. Lastly, for delivery pizza, the method often involves inserting the pizza-loaded box into a heat-retentive holding device such as a delivery bag.

In addition to heat loss, a further problem occurs when two loaded corrugated boxes are stacked. The bottom panel of the upper box is put into contact with the cover of the lower box. This results in condensation build-up within the cover of the lower box, making for an undesirably soggy box top. So it also would be desirable to have a method of shipping hot pizza whereby the bottom panel of the upper corrugated box is kept free of contact with the cover of the lower box.

In short, it would be desirable to have a method of shipping recently-cooked pizzeria pizza in corrugated box packaging wherein the loss of heat from the pizza through the bottom panel of the box is reduced, thereby keeping the pizza hot for a longer time.

In addition to the conventional shipping method, the prior art contains several other pizza shipping methods. They include those disclosed in Kuchenbecker U.S. Pat. No. 4,096,948 (Cook-in Carton with Integral Removable Section and Blank Therefor) granted Jun. 27, 1978; Faller U.S. Pat. No. 4,260,060 (Food Carton for Microwave Heating) granted Apr. 7, 1981; Peleg et al. U.S. Pat. No. 5,077,455 (Easy Open Microwave Susceptor Sleeve for Pizza and the Like) granted Dec. 31, 1991; France U.S. Pat. No. 5,253,800 (Pizza Tray) granted Oct. 19, 1993; Valdman et al. U.S. Pat. No. 5,423,477 (Pizza Box) granted Jun. 13, 1995; and Correll U.S. Pat. No. 5,549,241 (Interlock for Stackable Boxes) granted Aug. 27, 1996. In addition, there's a rigid foam insulating tray, called the PIZZA CADDY® insulating tray, which adhesively secures to the bottom of a pizza box for reducing condensation, catching leakage, and preventing burning of the legs when carrying it on one's lap. However, each of these methods is either inapplicable to the situation and problems involved in shipping hot pizzeria pizza in corrugated box packaging or has a major drawback as regards the pizzeria industry. Following are the particulars.

The Kuchenbecker method does not pertain to shipping hot pizzeria pizza but, instead, involves the microwave heating of frozen pizza. The carton is a glued-corner (i.e., fastened-corner) carton with interior openings in the bottom panel. The purpose of the openings is to allow gases to dissipate from the carton during microwaving. The carton has two panels glued to the bottom of the box which are folded downward just prior to microwaving to raise the bottom of the box above the floor of the microwave oven, thereby facilitating ventilation of the carton. This method is inapplicable to the situation of the pizzeria industry and to shipping hot pizzeria pizza in corrugated box packaging.

The Faller method does not pertain to shipping hot pizzeria pizza but, like the Kuchenbecker method, involves the microwave heating of frozen pizza. The carton is a glued-corner (i.e., fastened-corner) carton having a bottom panel with interior openings and also downward-projecting and upward-projecting tabs extending from the bottom panel. During shipment, these tabs are disposed coplanar with the bottom panel and, just prior to microwaving, the tabs are moved into a perpendicular disposition to the bottom panel by removing a glued-on film strip. The purpose of the openings and tabs is to allow gases to dissipate from the carton during microwaving and also to raise the pizza above the bottom panel of the box. As with the Kuchenbecker method, this method is inapplicable to the situation of the pizzeria industry and to shipping hot pizzeria pizza in corrugated box packaging.

The Peleg et al. method does not pertain to shipping hot pizzeria pizza but, like the Kuchenbecker and Faller methods, involves the microwave heating of frozen pizza. This method does not involve a carton, per se, but actually involves a sleeve that's open on opposing ends. The sleeve is shipped in flat (i.e., blank) format and the consumer erects it and places the pizza within it just prior to microwaving. The sleeve is made of microwave susceptor material to facilitate heating of the pizza and has tabs projecting downward from opposing sides of the sleeve to raise the bottom panel of the sleeve above the floor of the microwave oven during heating. This creates a space between the sleeve and floor of the oven which facilitates convective flow of air underneath the sleeve. As with the Kuchenbecker and Faller methods, this method is inapplicable to the situation of the pizzeria industry and to shipping hot pizzeria pizza in corrugated box packaging.

The France method does not involve a box but, rather, involves serving a pizza on an open tray having tabs projecting downward through interior openings in the bottom panel. This method doesn't apply to the process of shipping hot pizza in a closed container or box and, as a result, does not apply to improving heat-retention of boxed pizza.

The Valdman et al. method requires a molded container, typically made of molded paper pulp, and therefore is inapplicable to the process of shipping pizza in corrugated box packaging. This carton has a circular perimeter edge and a raised bottom panel. Being a molded container, the manufacturing process for making this carton is slow and, therefore, expensive; making this pizza-shipping method an unfeasible and undesirable method for pizzerias and also inapplicable to the situation involving corrugated box packaging.

The Correll method (U.S. Pat. No. 5,549,241) involves packing a pizza in a box having four downward-projecting tabs that extend about six millimeters below the bottom panel of the box. However, as with the conventional corrugated pizza box, these tabs do not extend far enough below the bottom panel to hold the bottom of a large E-flute corrugated box above a support surface once the bottom panel warps downward due to the steam of the hot pizza. Therefore, this method provides little or no reduction in conductive heat loss through the bottom panel of the box. Hence, it provides little or no heat-retentive benefit.

As previously discussed, the conventional pizza box (illustrated by the Anatro box) used in the conventional shipping method involves two downward-projecting tabs that extend about six millimeters below the bottom panel of the box. However, like the above-described Correll method, the tabs involved in the conventional shipping method do not extend far enough below the bottom panel to hold the bottom of a large E-flute corrugated box above a support surface once the bottom panel warps downward due to the heat and moisture of the hot pizza. Therefore, this method provides little or no reduction in conductive heat loss through the bottom panel of the box.

The PIZZA CADDY® insulating tray method does not actually pertain to a box, per se, but instead involves sticking a rigid foam insulating tray to the bottom of a box. As such, it's time-consuming and also expensive, which are major drawbacks to many pizza companies.

So, there has remained a problem of how to easily and economically reduce heat loss of hot pizzeria pizza when that pizza is shipped in corrugated box packaging. There has also remained a problem of how to stack two loaded corrugated boxes so that there is no condensation build-up on the bottom and top panels of the upper and lower boxes, respectively. These problems have not been solved by the prior art but are solved by my invention. By solving these problems, a pizza company can provide economical corrugated boxed pizza that stays hot for a longer period of time, thereby providing a more-enjoyable pizza-eating experience to its customers, and can do it without incurring substantial additional packaging cost and operational inconvenience.

SUMMARY OF THE INVENTION

My invention is a method for reducing heat loss of hot pizzeria pizza shipped in corrugated box packaging. The method comprises the step of placing a recently-cooked pizzeria pizza into a thermal-leg-equipped one-piece corrugated box, whereby a pizza-loaded thermal-leg-equipped corrugated box is created. The method solves two particular problems associated with the conventional shipping method for hot pizza.

First, the method solves the problem of a downward-warping bottom panel of a loaded corrugated pizza box coming into contact with a cool support surface upon which the box might be sitting.

Second, the method solves the problem of condensation build-up between the cover of a lower box and the bottom panel of an upper box of two stacked loaded corrugated pizza boxes.

Neither of these two problems is solved by the prior art of pizza shipping methods. A complete understanding of the invention can be obtained from the detailed description that follows.

OBJECT AND ADVANTAGES

Accordingly, the main object of my invention is a reduction in heat loss of recently-cooked pizzeria pizza shipped in corrugated box packaging. A secondary object is a reduction in condensation build-up on a cover of a corrugated box when two loaded pizza boxes are stacked one on top of the other.

The advantages of my invention are (a) hotter pizza for pizza consumers receiving pizza in corrugated box packaging (without incurring substantial additional cost and operational inconvenience for pizza companies), and (b) pizza delivered in a dryer corrugated box when multiple pizza boxes are stacked.

Further objects and advantages of the invention will become apparent from consideration of the following detailed description, related drawings, and appended claims.

LIST OF REFERENCE NUMERALS

Figure 1:
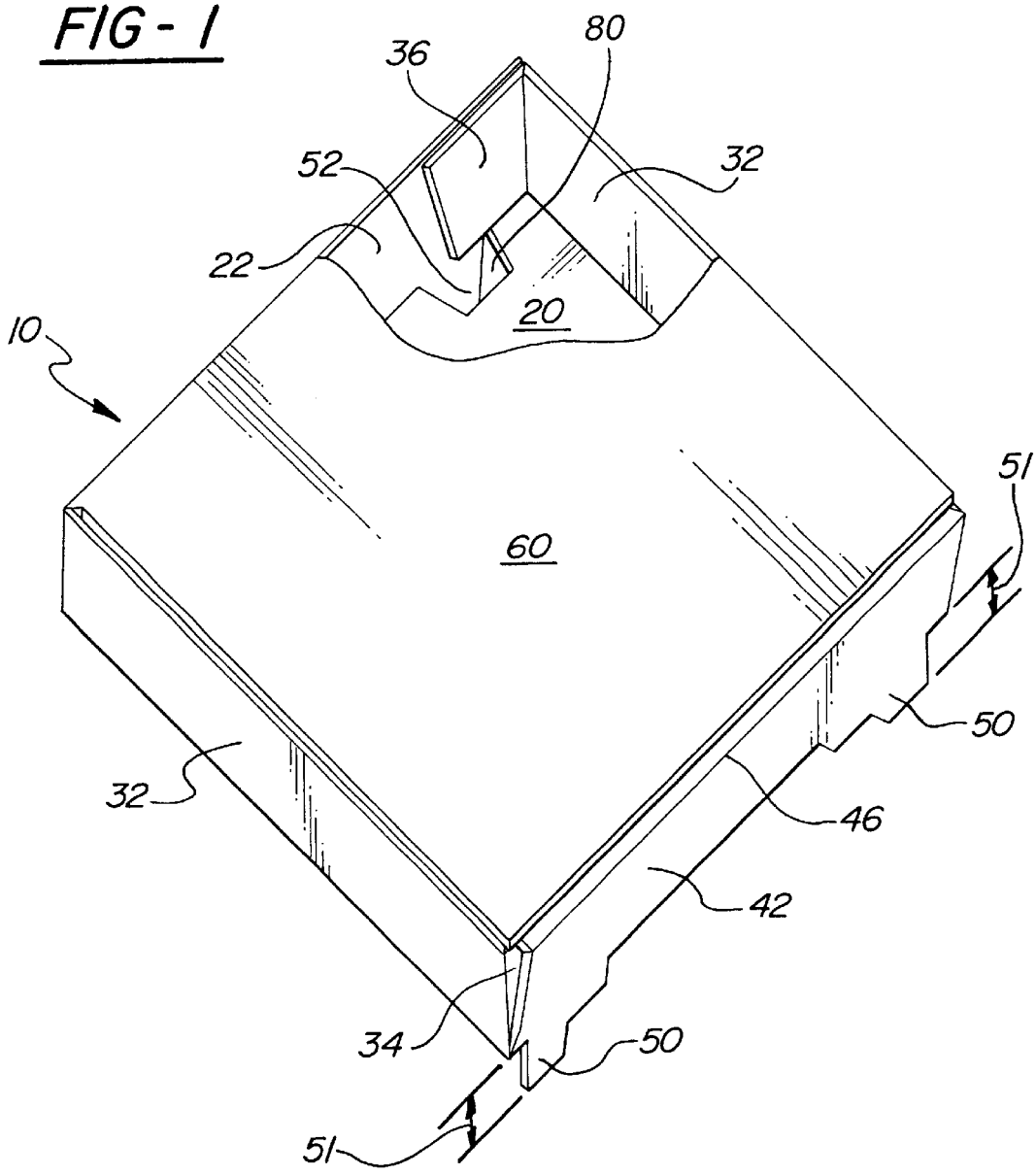
FIG. 1 is a perspective view of the preferred box for use with the method.

Between drawings, like reference numerals designate corresponding parts.

10 preferred box in closed, or fully-erected, format
12 blank for the preferred box
14 preferred box in open, or partially-erected, format
16 stack of preferred boxes
20 bottom panel
21 perimeter edge of bottom panel
22 rear wall panel
23 bottom edge of rear wall
30 side wall structure
31 bottom edge of side wall
32 side wall panel
34 front corner flap
36 rear corner flap
40 front wall structure
41 bottom edge of front wall (outer wall panel)
42 outer wall panel
44 inner wall panel
46 pair of fold lines
47 tab
48 hole-covering flap
50 front thermal-leg
51 height of thermal-leg
52 rear thermal-leg
53 height of thermal-leg
54 alternate thermal-leg
56 alternate thermal-leg
57 first portion
58 second portion
60 cover
62 cover side flap
64 cover front flap
71 slot
72 fold line
73 support surface
74 air gap
75 pizza-cutting support surface
76 air gap
78 center point of downward-warping bottom panel
80 opening in the bottom side of the box

DESCRIPTION OF THE PREFERRED PIZZA BOX FOR USE WITH THE METHOD

The inventive method described herein involves a corrugated pizza box having one or more thermal-legs, otherwise called a thermal-leg-equipped corrugated box. Certain key terms pertain to this box and the associated inventive method. These terms are now defined as used herein.

Definition of Key Terms

A "box" is a multi-paneled carton made of foldable material which, when fully erected, is enclosed on all sides to produce an enclosed inner cavity. A tray, which is a carton that's open on the top and/or the ends when it's in fully-erected disposition, is not considered to be a box and, therefore, is not usable with this method.

A "paperboard box" is a box made of paperboard.

A "corrugated box" is a box made of corrugated paperboard. Corrugated paperboard is a board comprised of at least one flat piece of paper (called a liner) and at least one fluted piece of paper (called a medium) that is glued to the flat piece of paper.

A "one-piece box" is a box that has a cover hingedly attached to one of the wall panels of the box. So a "one-piece corrugated box" is a box made of corrugated paperboard and which has a cover hingedly attached to one of the wall panels.

A "thermal-leg-equipped box" is a box having at least one thermal-leg.

A "thermal-leg," as the term is used herein, is a downward projection of a wall structure or of a wall panel of a box, that projection extending beyond a bottom edge of that wall structure or wall panel by a distance of at least nine millimeters when the box is in a fully-erected format. As regards what is and is not a thermal-leg, the following three distinctions are noted. First, a projection that does not extend at least nine millimeters beyond a bottom edge of a wall panel is NOT considered to be a thermal-leg (as, for example, is the case with the conventional corrugated pizza box, the Anatro '392 box, and the Correll '241 box). Second, a projection extending from a bottom panel of a box is NOT considered to be a thermal-leg (as, for example, is the case with the Faller '060 box and the Valdman et al. '477 carton). Third, the situation wherein a carton happens to have a bottom section that's elevated above the bottom edge of a wall section does NOT mean that the carton possesses a thermal-leg (as, for example, is the case with the Valdman et al. '477 carton).

It is noted that a "wall structure" can consist of a single wall panel, a plurality of hingedly connected wall panels, or a combination of one or more wall panels with one or more corner flaps attached thereto. Accordingly, a wall structure can be of double-panel construction, which could involve an outer wall panel and an inner wall panel hingedly linked to the outer wall panel and disposed parallel to it. A thermal-leg can project from a wall panel (including either an outer wall panel or an inner wall panel) and/or from a corner flap attached to a wall panel.

So, a "thermal-leg-equipped corrugated box" is a corrugated box that has at least one thermal-leg.

A "thermal-leg-equipped one-piece corrugated box" is a thermal-leg-equipped box made of corrugated paperboard and which has a cover hingedly attached to one of the wall panels of the box.

A "pizza-loaded thermal-leg-equipped corrugated box" is a thermal-leg-equipped corrugated box that's holding a recently-cooked pizzeria pizza.

An "interior opening in the bottom panel of a box" is an opening that is surrounded on all sides by that bottom panel. An opening in the bottom of a box that is not surrounded by the bottom panel of the box does not constitute an interior opening in the bottom panel of the box.

A "recently-cooked pizza" is a pizza that has been cooked, or baked, within the immediately-preceding sixty minutes.

Finally, a "pizzeria pizza" is a pizza prepared in and/or sold by a pizzeria, a restaurant, or any other type of commercial foodservice enterprise that provides hot pizza ready for immediate consumption.

Structure of the Pizza Box

Figure 2:
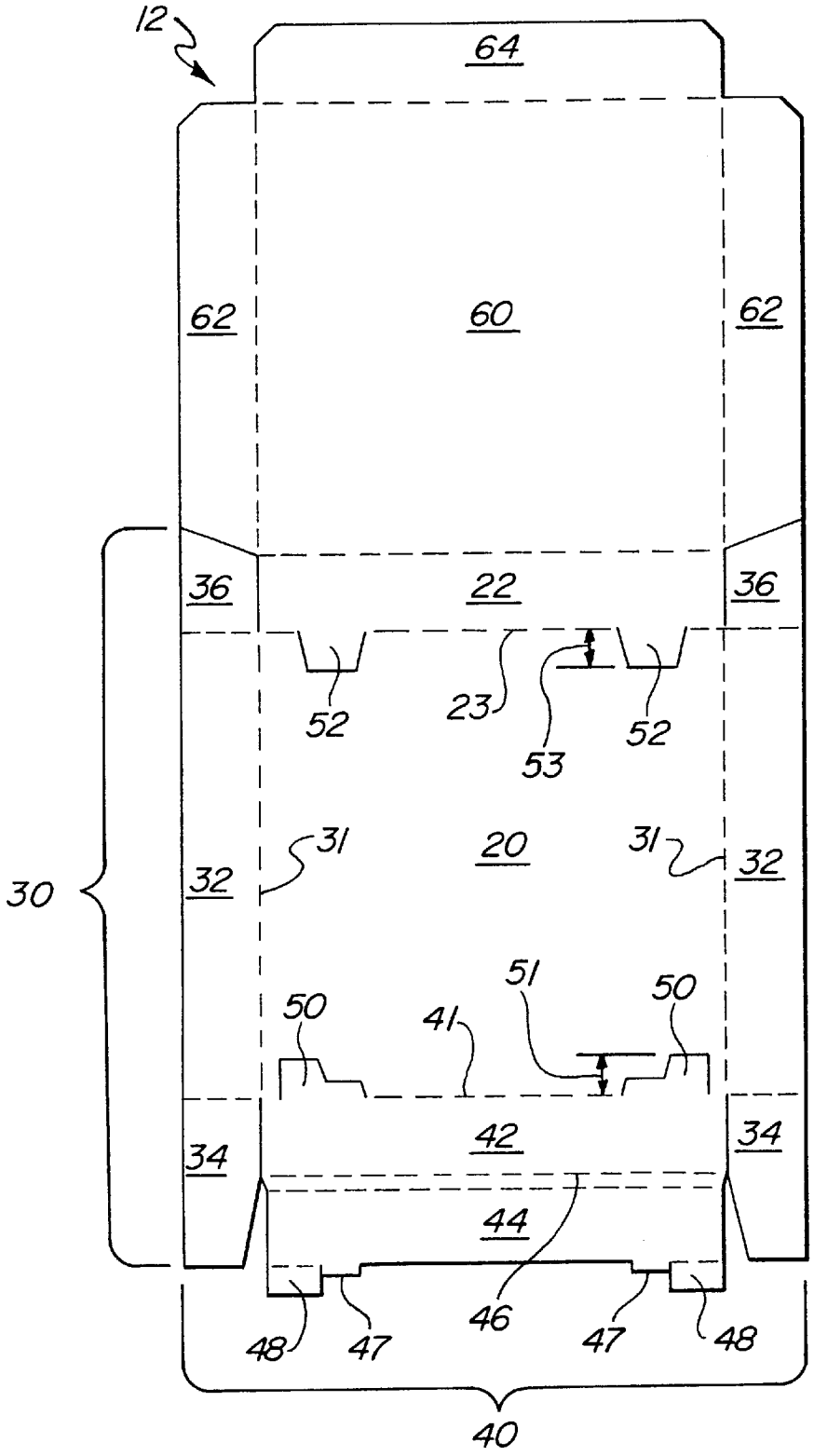
FIG. 2 is a plan view of the blank for making the preferred box of FIG. 1.

Referring now to FIG. 1, there is shown a thermal-leg-equipped one-piece corrugated box 10, which is the preferred type of thermal-leg-equipped corrugated box used in the instant inventive method. FIG. 2 shows a blank 12, which is the blank used for creating box 10. Those components of the box which are not visible in FIG. 1 are visible in FIG. 2.

Before starting the description, it is noted that corresponding parts between drawings share a same reference numeral. It is further noted that the box and blank are bilaterally symmetrical. Therefore, pairs of opposing like components are to be found, with one item of the pair on each side of the box or blank. For simplicity of labeling, each component pair may be indicated by a numeral on one side of the drawing only. Where this occurs, it is to be understood that the discussion also applies to the corresponding component on the other side, even though that component may not be numerically labeled.

Figure 10:
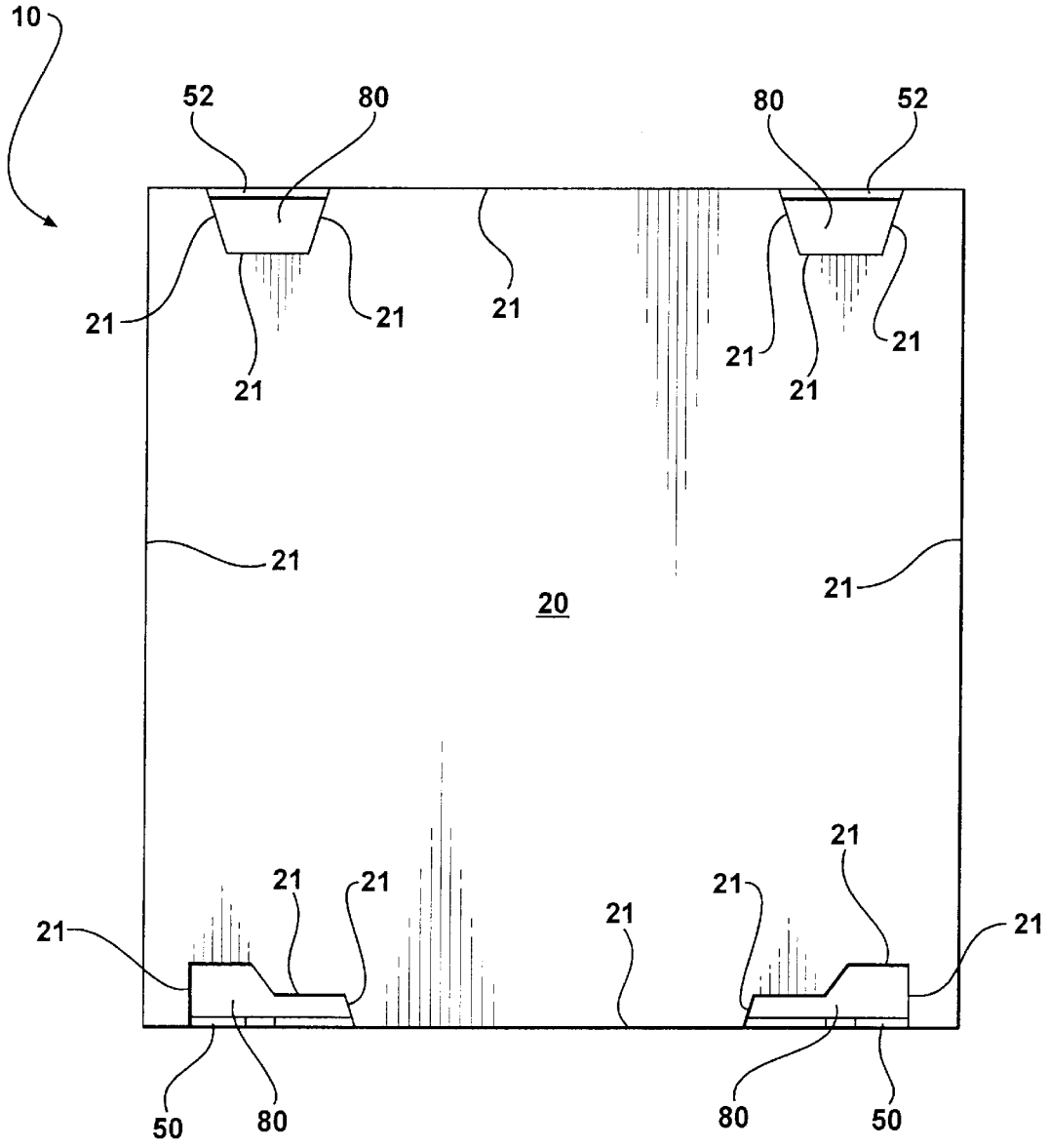
FIG. 10 is a bottom view of the preferred box for use with the method.

Blank 12 and box 10 have a bottom panel 20. Bottom panel 20 has a perimeter edge 21. Perimeter edge 21 is depicted in FIG. 10, which shows a view of the bottom side of box 10 with perimeter edge 21 being marked at various spots. As can be seen, bottom panel 20 is non-rectangular due to two opposing pairs of indentations along perimeter edge 21. These indentations are caused by thermal-legs 50 and 52 (which project downward from the bottom edge of front and rear wall panels, respectively). A complete discussion of thermal-legs appears in an ensuing paragraph.

A rear wall 22 is hingedly attached to bottom panel 20 at a fold line 23 (which also represents the bottom edge of rear wall 22).

A pair of opposing side wall structures 30 are attached to bottom panel 20 at fold lines 31 (which also represent the bottom edge of side walls 32). Each side wall structure 30 comprises a side wall 32, a front corner flap 34, and a rear corner flap 36.

A double-panel front wall structure 40 is attached to bottom panel 20 at a fold line 41 (which also represents the bottom edge of outer wall panel 42). Front wall structure 40 comprises an outer wall panel 42, an inner wall panel 44 hingedly linked to a top edge of panel 42 at a pair of narrowly-spaced parallel fold lines 46, a pair of tabs 47 projecting from a bottom edge of inner wall panel 44, and a pair of hole-covering flaps 48 hingedly attached to inner wall panel 44. Tab 47 holds front wall structure 40 in upright disposition when the box is in erected format.

As the term is used herein, a "hole-covering flap" is a flap attached to a bottom edge of an inner wall panel of a double-panel wall structure and which covers a hole somewhere in the box when the box is in erected format.

Projecting from outer wall panel 42 are a pair of front thermal-legs 50. Projecting from rear wall 22 are a pair of rear thermal-legs 52. In the blank format, the edge of each of these legs is contiguous with the perimeter edge of bottom panel 20. In FIG. 10 the various sections of the perimeter edge of bottom panel 20 are designated with numeral 21. In FIG. 2 the contiguous contact between the thermal-legs and perimeter edge of bottom panel 20 can be seen (although the perimeter edge is not designated by the numeral 21.) It is important to realize that (a) these thermal-legs do not constitute a part of the bottom panel of the box and (b) these thermal-legs are not formed from the bottom panel of the box. Rather, thermal-legs 50 and 52 are components of walls 42 and 22, not of bottom panel 20.

When blank 12 is erected into box 10, thermal-legs 50 and 52 move from a coplanar position to bottom panel 20 to a substantially perpendicular position to bottom panel 20. This results in openings 80 (four of them) being created in the bottom side of the box. These openings are shown in FIG. 10 which depicts a bottom view of box 10. It is important to realize that each opening 80 is an opening in the bottom side of box 10 and is not an opening within the interior of bottom panel 20. As the term is used herein, an "interior opening in the bottom panel of a box" is an opening that is surrounded on all sides by that bottom panel. Openings 80 are not surrounded on all sides by bottom panel 20 and, therefore, do not constitute interior openings in bottom panel 20.

Each thermal-leg has a particular height, which is the distance that the thermal-leg extends beyond the bottom edge of a wall panel. Thermal-legs 50 have a height 51, which is the distance that thermal-legs 50 extend beyond bottom edge 41 of outer wall panel 42. Thermal-legs 52 have a height 53, which is the distance that thermal-legs 52 extend beyond bottom edge 23 of rear wall 22.

Figure 3:
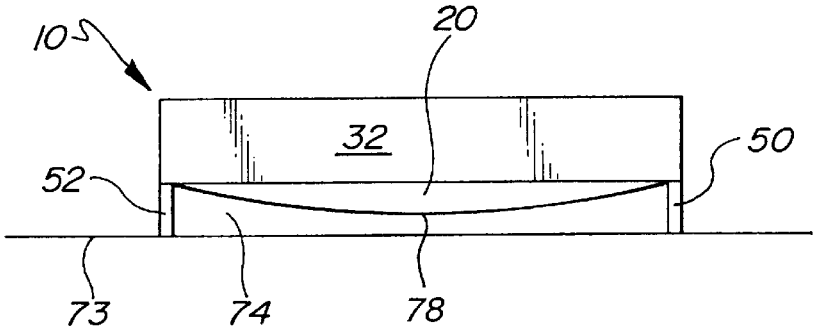
FIG. 3 is a left side elevation view of the preferred box loaded with pizza, sitting on a support surface.

Heights 51 and 53 are at least nine millimeters. (If the height of a leg-type projection is less than nine millimeters, the projection is not considered to be a thermal-leg as regards the inventive method described herein.) However, it can be desirable for a thermal-leg height to be greater than nine millimeters, such as being ten, eleven, twelve or more millimeters. The proper height for particular thermal-legs depends on the flute thickness of the corrugated board of the box and on the size of the box. Generally, the thinner the flute and the larger the box, the longer the height that the thermal-legs should be. That's because thinner flutes and larger box sizes tend to result in a greater degree of downward warp in the bottom panel of a pizza-loaded box, which must be compensated for by a greater height of thermal-legs. FIG. 3 shows bottom panel 20 in a downward-warping disposition. FIG. 3 also shows box 10 sitting on a support surface 73 with an air gap 74 between downward-warping bottom panel 20 and support surface 73.

A cover 60 is hingedly attached to a top edge of rear wall 22. A pair of cover side flaps 62 and a cover front flap 64 are hingedly attached to cover 60.

Summary of Salient Features of the Box Structure

It is important to realize that the preferred embodiment of the pizza box associated with the instant inventive method has a number of key salient features.

First, the box is made of corrugated paperboard and, therefore, is a corrugated pizza box. It is not a molded paper pulp box, or a chipboard box, or a plastic box, or a rigid foam box. Accordingly, the instant inventive method pertains to corrugated box packaging exclusively; it does not pertain to other types of packaging. Conversely, the methods pertaining to other types of packaging do not pertain to corrugated pizza box packaging.

Second, the downward-projecting legs of the box (i.e., thermal-legs 50, 52) are downward projections of the wall panels of the box and, therefore, are NOT downward projections of the bottom panel of the box. Accordingly, the instant inventive method pertains to thermal-legs exclusively (as defined herein); it does not pertain to other types of legs. Conversely, the methods pertaining to other types of legs (such as those projecting from a bottom panel) do not pertain to thermal-legs.

Third, the box is a one-piece box, meaning that it has a cover hingedly attached to one of the walls of the box.

Figure 5:
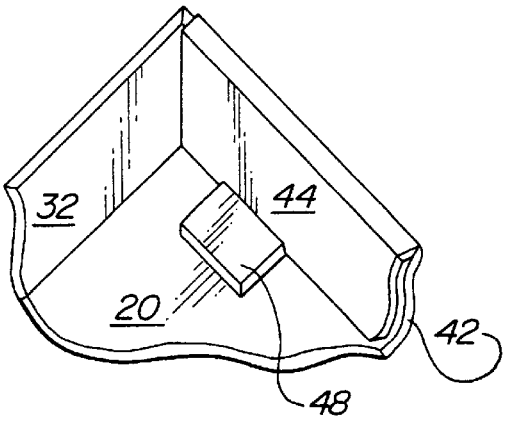
FIG. 5 is an inside perspective view of the right front corner section of the preferred box.

Fourth, bottom panel 20 of the box is free of interior openings. As previously described and as can be seen in FIG. 10, openings 80 located on the bottom side of box 10 are located outside of perimeter edge 21 of bottom panel 20 and, therefore, are not interior openings in bottom panel 20. For illustrative comparison, it is noted that in the box disclosed in FIGS. 1 and 3 of Kuchenbecker U.S. Pat. No. 4,096,948, the opening 14 in bottom panel 10 is an interior opening. For further illustration, in the box disclosed in FIG. 5 of Faller U.S. Pat. No. 4,260,060, the opening created in bottom panel 2 by tab 4 is an interior opening. For still further illustration, in the tray disclosed in France U.S. Pat. No. 5,253,800, the opening created in bottom panel, or base, 13 by flange 44 is an interior opening.

Fifth, bottom panel 20 is free of projections extending therefrom. As previously described and as can be seen in FIGS. 3 and 10, there are no projections extending from bottom panel 20. The only downward projections on box 10 are thermal-legs 50 and 52. As previously described and as shown in FIGS. 1 and 2, thermal-legs 50, 52 extend from walls 42, 22, respectively, not from bottom panel 20. For illustrative comparison, it is noted that in the box disclosed in FIG. 1 of Valdman et al. U.S. Pat. No. 5,423,477, bottom panel, or floor portion, 35 of that box has projections 46 extending upward from the bottom panel and projections 48 extending downward from the bottom panel. For further illustration, it is noted out that in the box disclosed in FIG. 5 of Faller U.S. Pat. No. 4,260,060, bottom panel 2 of that box has projections 4 extending both upward and downward from the bottom panel.

Sixth, rear thermal-legs 52 are open-carton-retracting thermal-legs. "Open-carton-retracting thermal-legs" are thermal-legs that are disposed in an upright position when the box is in closed, or fully-erected, format (as depicted in FIG. 1) but move to a non-upright, or retracted, position when the cover is laid back, thereby putting the box in open or partially-erected format, as depicted by box 14 in FIG. 4. Accordingly, when cover 60 of partially-erected box 14 is closed upon the box, the forward movement of the cover causes rear wall 22 to move from a coplanar to a perpendicular position in relation to bottom panel 20. That change in rear wall position simultaneously causes rear thermal-legs 52 to move from a non-upright position to an upright position. The typical non-upright position has the thermal-legs disposed approximately coplanar to the bottom panel but any position that's less than a full upright position would be considered to be non-upright.

Seventh, the box of the preferred embodiment is a non-fastened-corner box. As the term is used herein, a "fastened-corner box" is a box that has at least one corner formed by gluing, taping, or stapling one wall structure to an adjacent wall structure. A "non-fastened-corner box" is a box that has no corner formed by gluing, taping, or stapling one wall structure to an adjacent wall structure.

Eighth, the box of the preferred embodiment is a folder-style box. As the term is used herein, a "folder-style box" is a box that's shipped from the factory in the blank format and is erected, or folded, into a box at the point of use (e.g., the pizzeria). This type of box contrasts with a pre-erected box, such as a clamshell-type box, which is shipped from the factory in the format of either a partially-erected box or a fully-erected box. It also contrasts with a molded carton (e.g., a rigid foam carton and a molded paper pulp carton such as the Valdman et al. '477 carton) which are made from a mold rather than erected from a box blank.

It is noted that the structure of the box used in the instant inventive method involves fold lines. As the term is used herein, a "fold line" is a line between two points on a box blank or on a box where folding occurs (or occurred) when the blank is (or was) erected into a box. A fold line is typically created by inserting a score or a series of aligned slits (a.k.a. a perf line) into the blank. However, other forms of fold lines may be used.

In short, the preferred embodiment of the pizza box used with the inventive method is a one-piece, non-fastened-corner, folder-style, thermal-leg-equipped corrugated box having a bottom panel free of interior openings therein and free of projections extending therefrom.

Alternate Configurations of Thermal-Legs and Thermal-Leg-Equipped Boxes

Even though the above-described box is the preferred box for use with the invented method, it should be appreciated that other configurations of thermal-legs and thermal-leg-equipped boxes can be used. Some of these boxes are disclosed and discussed in prior patents and patent applications of mine: specifically, in Correll U.S. Pat. No. 5,833,130 (Multi-function Pizza Carton), Correll U.S. Pat. No. 5,961,035 (Designer Pizza Box with Enhancements), Correll U.S. Pat. No. 6,206,277 (Quality-enhancing Pizza Carton), and Correll U.S. Pat. No. 6,290,122 (Versatile Pizza Carton). The structure and discussion of thermal-legs and thermal-leg-equipped boxes disclosed in these patents and applications are included herein by reference thereto.

Figure 6:
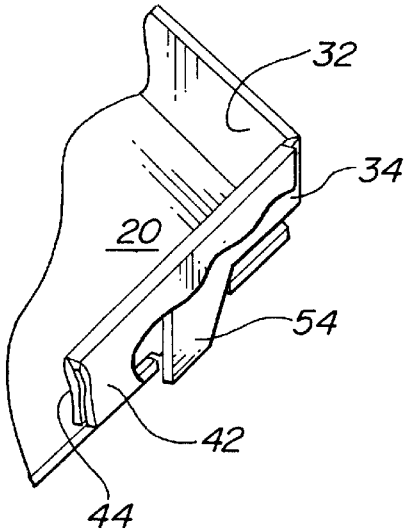
FIG. 6 is a cut-away perspective view of a right front corner section of an alternate open box that shows an alternate configuration of thermal-leg.
Figure 7:
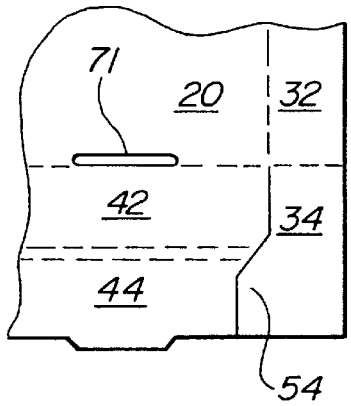
FIG. 7 is a section of blank for making the structure shown in FIG. 6.

In the preferred embodiment of the box thermal-legs extend from wall panels. However, it's possible for thermal-legs to extend from corner flaps, as well. This is disclosed in Correll U.S. Pat. No. 5,961,035 (Designer Pizza Box with Enhancements) and Correll U.S. Pat. No. 6,290,122 (Versatile Pizza Carton). A first example is illustrated in FIG. 6, which shows a cut-away right front corner section of an open box. In the Figure, a thermal-leg 54 extends from a bottom edge of a front corner flap 34. FIG. 7 shows this structure in the blank format, which includes a slot 71 through which thermal-leg 54 extends when the blank is erected into a box.

Figure 8:
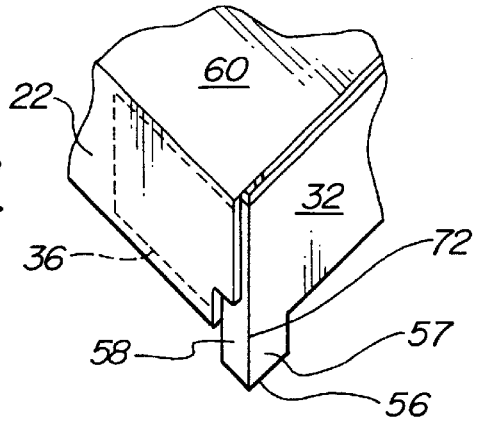
FIG. 8 is a perspective view of a rear corner section of an alternate closed box that shows an alternate configuration of thermal-leg.

A second example is illustrated in FIG. 8, which shows a rear corner section of a closed box. What is shown is a two-part combination thermal-leg 56 extending jointly from a side wall 32 and a rear corner flap 36 (which in the drawing is covered by a rear wall 22.) The two parts of thermal-leg 56 are a first portion 57 and a second portion 58. Portion 57 extends from side wall 32 and portion 58 extends from rear corner flap 36. The two portions are joined at a fold line 72 and are disposed perpendicularly.

Although an example is not shown, it is noted that it's also possible for a thermal-leg to project from inner wall panel 44.

DESCRIPTION OF A PREFERRED EMBODIMENT OF THE METHOD

This invention is a method for reducing heat loss of hot pizzeria pizza shipped in corrugated box packaging. The method has been alluded to and discussed in previous U.S. patent applications of mine: specifically, application Ser. No. 09/551,245 (Versatile Pizza Carton) filed Apr. 17, 2000, now U.S. Pat. No. 6,290,122; application Ser. No. 09/394,784 (Quality-enhancing Pizza Carton) filed Sep. 13, 1999, now U.S. Pat. No. 6,206,277; application Ser. No. 09/061,302 (Designer Pizza Box with Enhancements) filed Apr. 16, 1998, now U.S. Pat. No. 5,961,035; and application Ser. No. 08/731,586 (Multi-function Pizza Carton) filed Oct. 6, 1996, now U.S. Pat. No. 5,833,130.

Each of those patents refers to shipping a recently-cooked pizzeria pizza in a corrugated pizza box having at least one thermal-leg, whereby a downward-warping bottom panel of the box is held out of contact with a cool support surface such as a tabletop or a floor of an automotive vehicle. As used herein, a "cool support surface" is defined as a support surface that has a temperature that's cooler than the temperature of the pizza in the box.

A preferred embodiment of the method comprises the following steps.

STEP A: Positioning a thermal-leg-equipped one-piece corrugated box (e.g., box 10) on a pizza-cutting support surface in a disposition wherein the bottom panel of the box is disposed in contact with the support surface. This disposition allows a pizza to be cut in the box without bending the thermal-legs. Typical pizza-cutting support surfaces include the top of a table, counter, cutting board, or wire rack.

Figure 4:
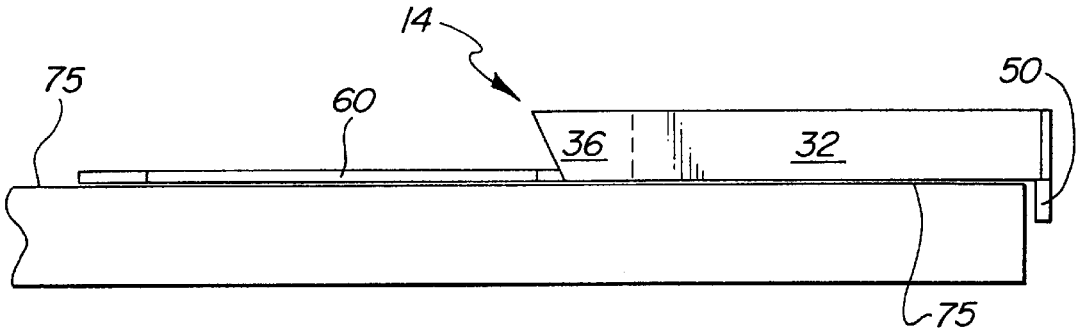
FIG. 4 is a left side elevation view of the preferred box in partially-erected, or open, disposition, sitting on a support surface.

The best way to position bottom panel 20 in contact with a pizza-cutting support surface is to position front thermal-legs 50 below the plane of the support surface. And an easy way to position thermal-legs 50 below the plane of a support surface is to position them off an edge of the support surface. This disposition is illustrated in FIG. 4, which shows a left side view of partially-erected box 14 sitting on top of pizza-cutting support surface 75, with thermal-legs 50 disposed off of support surface 75 and, thereby, below the plane of support surface 75. It is noted that support surface 75 is any surface upon which the box rests while the pizza is being cut in the box. In FIG. 4 a slight gap is shown between box 14 and support surface 75. This is to clearly differentiate the box from the support surface; typically the box would sit directly on the support surface.

In addition, it's possible to have a pizza-cutting support surface that has openings in it sized to allow thermal-legs to fit into them, thereby allowing the thermal-legs to be disposed below the plane of the support surface and, thereby, enabling the bottom panel of the box to be in contact with the support surface.

STEP B: Placing a recently-cooked pizzeria pizza into the thermal-leg-equipped one-piece corrugated box and, thereby, creating a pizza-loaded thermal-leg-equipped corrugated box. This pizza-loaded thermal-leg-equipped corrugated box comprises the structural components of the previously-defined preferred pizza box along with a hot pizza.

STEP C: Transporting the pizza-loaded thermal-leg-equipped corrugated box from the pizzeria to an outlying place of consumption. The most common outlying place of consumption is the pizza-eater's residence, although any place where the pizza is consumed (i.e., workplace, picnic, etc.) is considered to be an outlying place of consumption.

STEP D: Setting the pizza-loaded thermal-leg-equipped corrugated box on a cool support surface located at the outlying place of consumption. Typical support surfaces are tabletop and countertop. The way most consumers eat boxed pizza is that they open the box, remove a slice of pizza for eating, and then re-close the box to keep the remaining pizza hot. While in closed format, the downward-warping bottom panel of the pizza-loaded thermal-leg-equipped corrugated box is held above, or free of contact with, the relatively cool support surface (as illustrated in FIG. 3). Because of this, the pizza undergoes a slower rate of cooling than if the bottom panel of the box were in contact with the support surface.

As shown in FIG. 3, the height of thermal-legs 50, 52 is sufficient to keep a center point 78 of bottom panel 20 above and free of contact with support surface 73. Achieving this condition—i.e., keeping the downward-warping bottom panel of a loaded corrugated pizza box free of contact with an underlying cool support surface—is a key aspect of the instant inventive method and what makes this particular method unique from other pizza-shipping methods including those of Anatro, Faller, and Valdman et al.

Although four steps are described above, the essence of the method is contained in the placing step (step B): specifically, placing a recently-cooked pizzeria pizza into a thermal-leg-equipped corrugated box, thereby creating a pizza-loaded thermal-leg-equipped corrugated box. Even when the other steps are omitted, the inventive essence of the method still remains as long as the placing step is performed. Once the pizza is placed in the thermal-leg-equipped corrugated box, whenever that pizza-loaded thermal-leg-equipped corrugated box is placed on a cool support surface the downward-warping bottom panel of the box is held above, or free of contact with, the cool support surface, thereby achieving the object of the method.

Variations of the Method

The foregoing method describes a preferred embodiment, but other configurations of the method are possible. Examples of some common possible variations are as follows.

Variation 1: The positioning step is omitted. This could occur when a pizza is cut prior to loading it into the box.

Variation 2: The positioning step is performed subsequent to the placing step (rather than before). With this, the pizza-loaded thermal-leg-equipped corrugated box is positioned on a pizza-cutting surface in a disposition wherein the bottom panel of the box is disposed in contact with the support surface. This enables the pizza to be cut in the box without bending the thermal-legs.

Variation 3: The following step is performed subsequent to the placing step and before the transporting step: Setting the pizza-loaded thermal-leg-equipped corrugated box on a cool support surface. Typical support surfaces would be a tabletop, countertop, routing shelf, pick-up shelf, cover of a pizza box, box-support surface inside of a delivery pizza holding device such as a delivery bag or rigid foam box, and floor of an automotive vehicle. Setting the box on a floor of an automotive vehicle typically occurs with pick-up pizzas that are transported by the customer (as opposed to a delivery driver). In a delivery bag the box-support surface would be the inside surface or inner liner of the bag and also may be any board or board-type shelf inside the bag.

It is noted that while sitting on any of the above-cited support surfaces the downward-warping bottom panel of the box is held above, or free of contact with, the support surface by the thermal-legs, thereby creating an air gap between the box and support surface. This is illustrated in FIG. 3 which shows air gap 74 between the box and support surface. It is noted that the temperature of most support surfaces is cooler than that of the pizza. Therefore, by holding the bottom panel of the box out of contact of the cool support surface, the pizza undergoes a slower rate of cooling than if the bottom panel were in contact with the support surface.

Figure 9:
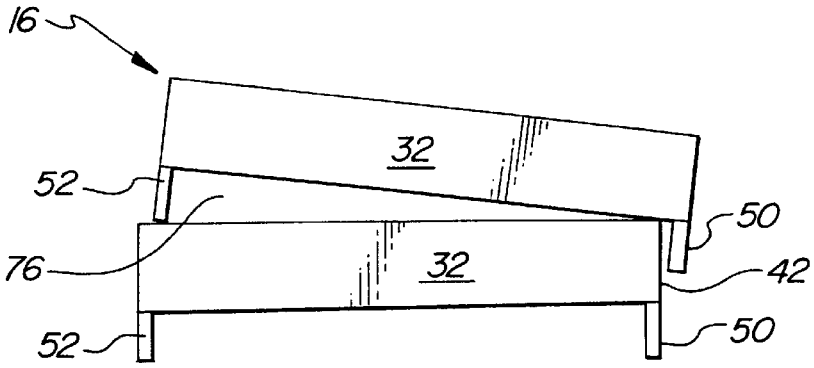
FIG. 9 is a left side elevation view of a stack of preferred boxes.

Variation 4: The following step is performed subsequent to the placing step: Stacking the pizza-loaded thermal-leg-equipped corrugated box on top of a second pizza-loaded thermal-leg-equipped corrugated box with either the front or the rear thermal-legs of the pizza-loaded thermal-leg-equipped corrugated box sitting on the cover of the second pizza-loaded thermal-leg-equipped corrugated box, thereby creating an air gap between the boxes. This is illustrated in FIG. 9 which shows a stack 16 of upper and lower pizza-loaded thermal-leg-equipped corrugated boxes with rear thermal-legs 52 of the upper box sitting on the cover of the lower box, thereby creating air gap 76 between the boxes. It is also noted that front thermal-legs 50 of the upper box are disposed on an exterior side of outer wall panel 42 of the lower box. This configuration enables the stack of boxes to be easily grasped with one hand. Finally, air gap 76 provides a secondary benefit of preventing condensation build-up on the cover of the lower box, thereby maintaining the cover of the lower box in a relatively dry (non-soggy) state.

Finally, combinations of the above four variations are possible.

Conclusion, Ramifications, and Scope

I have disclosed a method for reducing heat loss of hot pizzeria pizza shipped in corrugated box packaging. The method involves placing a recently-cooked pizzeria pizza into a thermal-leg-equipped corrugated box, thereby creating a pizza-loaded thermal-leg-equipped corrugated box. This method has been alluded to and discussed in four prior patents of mine, which have been previously cited.

The method solves the problem of a downward-warping bottom panel of a loaded corrugated pizza box coming into contact with a cool support surface upon which the box might be sitting. In addition, the method solves the problem of condensation build-up between the cover of a lower box and the bottom panel of an upper box of two stacked loaded corrugated pizza boxes.

I have shown how the instant inventive method distinguishes from the prior art methods, including that of Anatro, Faller, Valdman et al., and the conventional shipping method.

I have laid out an embodiment of the method comprising four steps. However, it should be understood that many variations of the method are possible within the scope of the invention, some of which have been described herein.

I have also described a preferred type of thermal-leg-equipped one-piece corrugated box recommended for use with the method. That box contains particular types of thermal-legs. I have also described two alternate types of thermal-legs. However, many other configurations of thermal-leg-equipped boxes and thermal-legs are possible within the scope of the invention.

On the preferred box four thermal-legs were shown; however, other numbers of thermal-legs are possible and would be regarded as being within the scope of the invention. For example, it's possible to have a box with only a single thermal-leg or with multiple thermal-legs disposed along one wall of the box only. In this situation, when the box is sitting on a support surface, the bottom edge of the opposing wall would rest on the support surface and, therefore, the bottom panel of the box would be disposed obliquely to the support surface as opposed to parallel to it.

In conclusion, it is understood that the invention is not to be limited to the disclosed embodiments and variations but, on the contrary, is intended to cover various modifications and equivalent arrangements included within the spirit and scope of the appended claims, which scope is to be accorded the broadest interpretation so as to encompass all such modifications and equivalent structures as is permitted under the law.

I claim:

1. A method for reducing heat loss of hot pizzeria pizza shipped in corrugated box packaging, said method comprising the steps of:

placing a recently-cooked pizza into a thermal-leg-equipped one-piece corrugated box and, thereby, creating a pizza-loaded thermal-leg-equipped corrugated box, said pizza-loaded thermal-leg-equipped corrugated box comprising a bottom panel, a plurality of wall structures including adjacent first and second wall structures attached to said bottom panel at respective first and second fold lines, at least one thermal-leg, a cover, and said pizza, said at least one thermal-leg being a downward projection of said first wall structure and extending beyond a bottom edge of a wall panel by a distance of at least nine millimeters when the box is in a fully-erected format, performing at least one of the following three steps: (1) prior to the placing step positioning said thermal-leg-equipped one-piece corrugated box on a support surface in a disposition wherein a substantial portion of at least one thermal-leg of the box is disposed below a plane of said support surface, (2) subsequent to the placing step positioning said pizza-loaded thermal-leg-equipped corrugated box on a support surface in a disposition wherein a substantial portion of said at least one thermal-leg is disposed below a plane of said support surface, and (3) subsequent to the placing step positioning said pizza-loaded thermal-leg-equipped corrugated box on top of a second pizza-loaded thermal-leg-equipped corrugated box wherein a substantial portion of said at least one thermal-leg is disposed on an exterior side of a wall of said second pizza-loaded thermal-leg-equipped corrugated box, and setting said pizza-loaded thermal-leg-equipped corrugated box on a cool support surface;

whereby when said bottom panel assumes a downward-warping disposition a center point of said bottom panel is disposed above and free of contact with said cool support surface; and whereby said method solves the problem of a downward-warping bottom panel of a loaded corrugated pizza box coming into contact with a cool support surface underneath the box.

2. The method of claim 1 wherein:

said cool support surface is a tabletop in a residence of a pizza consumer.

3. The method of claim 1 wherein:

said cool support surface is a floor of an automotive vehicle.

4. The method of claim 1 wherein:

said cool support surface is a cover of a pizza box.

5. The method of claim 1 further comprising the following step occurring prior to the placing step:

positioning said thermal-leg-equipped one-piece corrugated box on a pizza-cutting support surface in a disposition wherein a bottom panel of said thermal-leg-equipped one-piece corrugated box is in contact with said pizza-cutting support surface.

6. The method of claim 1 further comprising the following step occurring subsequent to the placing step and prior to the setting step:

positioning said pizza-loaded thermal-leg-equipped corrugated box on a pizza-cutting support surface in a disposition wherein the bottom panel of said pizza-loaded thermal-leg-equipped corrugated box is in contact with said pizza-cutting support surface.

7. The method of claim 1 further comprising the following step occurring subsequent to the placing step and prior to the setting step:

transporting said pizza-loaded thermal-leg-equipped corrugated box from a pizzeria to an outlying place of consumption.

8. The method of claim 7 further comprising the following step occurring subsequent to the placing step and prior to the transporting step:

stacking said pizza-loaded thermal-leg-equipped corrugated box on top of a second pizza-loaded thermal-leg-equipped corrugated box, wherein said at least one thermal-leg of said pizza-loaded thermal-leg-equipped corrugated box sits on a cover of said second pizza-loaded thermal-leg-equipped corrugated box, whereby a substantial air gap between the corrugated boxes is maintained.

9. The method of claim 7 wherein:

said pizza-loaded thermal-leg-equipped corrugated box further comprises opposing first and second thermal-legs respectively projecting from opposing first and second wall panels.

10. The method of claim 9 further comprising the following step occurring subsequent to the placing step and prior to the transporting step:

stacking said pizza-loaded thermal-leg-equipped corrugated box on top of a second pizza-loaded thermal-leg-equipped corrugated box, wherein one of the first and second thermal-legs of said pizza-loaded thermal-leg-equipped corrugated box sits on a cover of said second pizza-loaded thermal-leg-equipped corrugated box and the other of said first and second thermal-legs is disposed on an exterior side of a wall of said second pizza-loaded thermal-leg-equipped corrugated box.

11. The method of claim 1 wherein:

said at least one thermal-leg has a height of at least ten millimeters.

12. The method of claim 1 wherein:

said at least one thermal-leg has a height of at least eleven millimeters.

13. The method of claim 1 wherein:

said at least one thermal-leg has a height of at least twelve millimeters.

14. The method of claim 1 wherein:

said at least one thermal-leg projects from a corner flap.

15. The method of claim 1 wherein:

said at least one thermal-leg comprises a first portion joined at a fold line to a second portion, said first portion being disposed at an angle to said second portion.

16. The method of claim 1 wherein:

said at least one thermal-leg is an open-carton-retracting thermal-leg.

17. The method of claim 1 wherein:

said pizza-loaded thermal-leg-equipped corrugated box further comprises least one hole-covering flap.

18. The method of claim 1 wherein:

said pizza-loaded thermal-leg-equipped corrugated box is a folder-style box.

19. The method of claim 1 wherein:

said pizza-loaded thermal-leg-equipped corrugated box is a non-fastened-corner box.

20. A method for reducing heat loss of hot pizzeria pizza shipped in corrugated box packaging, said method comprising the steps of:

placing a recently-cooked pizza into a thermal-leg-equipped one-piece corrugated box and, thereby, creating a pizza-loaded thermal-leg-equipped corrugated box, said pizza-loaded thermal-leg-equipped corrugated box comprising a bottom panel free of a projection extending therefrom, a plurality of wall structures including adjacent first and second wall structures attached to said bottom panel at respective first and second fold lines, at least one thermal-leg projecting from one of said first and second wall structures, a cover, and said pizza, performing at least one of the following three steps: (1) prior to the placing step positioning said thermal-leg-equipped one-piece corrugated box on a support surface in a disposition wherein a substantial portion of at least one thermal-leg of the box is disposed below a plane of said support surface, (2) subsequent to the placing step positioning said pizza-loaded thermal-leg-equipped corrugated box on a support surface in a disposition wherein a substantial portion of said at least one thermal-leg is disposed below a plane of said support surface, and (3) subsequent to the placing step positioning said pizza-loaded thermal-leg-equipped corrugated box on top of a second pizza-loaded thermal-leg-equipped corrugated box wherein a substantial portion of said at least one thermal-leg is disposed on an exterior side of a wall of said second pizza-loaded thermal-leg-equipped corrugated box, and setting said pizza-loaded thermal-leg-equipped corrugated box on a cool support surface;

whereby when said bottom panel assumes a downward-warping disposition a center point of said bottom panel is disposed above and free of contact with said cool support surface; and whereby said method solves the problem of a downward-warping bottom panel of a loaded corrugated pizza box coming into contact with a cool support surface underneath the box.

21. The method of claim 20 wherein:

said pizza-loaded thermal-leg-equipped corrugated box is free of an interior opening within said bottom panel.

22. A method for reducing heat loss of hot pizzeria pizza shipped in corrugated box packaging, said method comprising the steps of:

placing a recently-cooked pizza into a thermal-leg-equipped one-piece corrugated box and, thereby, creating a pizza-loaded thermal-leg-equipped corrugated box, said pizza-loaded thermal-leg-equipped corrugated box comprising a bottom panel free of an interior opening therein, a plurality of wall structures including adjacent first and second wall structures attached to said bottom panel at respective first and second fold lines, at least one thermal-leg projecting from one of said first and second wall structures, a cover, and said pizza, performing at least one of the following three steps: (1) prior to the placing step positioning said thermal-leg-equipped one-piece corrugated box on a support surface in a disposition wherein a substantial portion of at least one thermal-leg of the box is disposed below a plane of said support surface, (2) subsequent to the placing step positioning said pizza-loaded thermal-leg-equipped corrugated box on a support surface in a disposition wherein a substantial portion of said at least one thermal-leg is disposed below a plane of said support surface, and (3) subsequent to the placing step positioning said pizza-loaded thermal-leg-equipped corrugated box on top of a second pizza-loaded thermal-leg-equipped corrugated box wherein a substantial portion of said at least one thermal-leg is disposed on an exterior side of a wall of said second pizza-loaded thermal-lea-equipped corrugated box, and setting said pizza-loaded thermal-leg-equipped corrugated box on a cool support surface;

whereby when said bottom panel assumes a downward-warping disposition a center point of said bottom panel is disposed above and free of contact with said cool support surface; and whereby said method solves the problem of a downward-warping bottom panel of a loaded corrugated pizza box coming into contact with a cool support surface underneath the box.

23. A method for reducing heat loss of hot pizzeria pizza shipped in corrugated box packaging, said method comprising the steps of:

placing a recently-cooked pizza into a thermal-leg-equipped one-piece corrugated box and, thereby, creating a pizza-loaded thermal-leg-equipped corrugated box, said pizza-loaded thermal-leg-equipped corrugated box being a non-fastened-corner folder-style box comprising a bottom panel free of a projection extending therefrom and free of an interior opening therein, a plurality of wall structures including adjacent first and second wall structures attached to said bottom panel at respective first and second fold lines, at least one thermal-leg, a cover, and said pizza, said at least one thermal-leg being a downward projection of said first wall structure and extending beyond a bottom edge of a wall panel by a distance of at least nine millimeters when the box is in a fully-erected format, performing at least one of the following three steps: (1) prior to the placing step positioning said thermal-leg-equipped one-piece corrugated box on a support surface in a disposition wherein a substantial portion of at least one thermal-leg of the box is disposed below a plane of said support surface, (2) subsequent to the placing step positioning said pizza-loaded thermal-leg-equipped corrugated box on a support surface in a disposition wherein a substantial portion of said at least one thermal-leg is disposed below a plane of said support surface, and (3) subsequent to the placing step positioning said pizza-loaded thermal-leg-equipped corrugated box on top of a second pizza-loaded thermal-leg-equipped corrugated box wherein a substantial portion of said at least one thermal-leg is disposed on an exterior side of a wall of said second pizza-loaded thermal-leg-equipped corrugated box, and setting said pizza-loaded thermal-leg-equipped corrugated box on a cool support surface;

whereby when said bottom panel assumes a downward-warping disposition a center point of said bottom panel is disposed above and free of contact with said cool support surface; and whereby said method solves the problem of a downward-warping bottom panel of a loaded corrugated pizza box coming into contact with a cool support surface underneath the box.

24. The method of claim 23 further comprising the following step occurring subsequent to the placing step and prior to the setting step:

transporting said pizza-loaded thermal-leg-equipped corrugated box from a pizzeria to an outlying place of consumption.

25. The method of claim 23 further comprising the following steps occurring subsequent to the setting step:

transporting said pizza-loaded thermal-leg-equipped corrugated box from a pizzeria to an outlying place of consumption, and setting said pizza-loaded thermal-leg-equipped corrugated box on another cool support surface, wherein a center point of said bottom panel is disposed above and free of contact with said another cool support surface.

* * * * *